US008968974B2

(12) United States Patent
Gila et al.

(10) Patent No.: US 8,968,974 B2
(45) Date of Patent: Mar. 3, 2015

(54) TECHNIQUES FOR COATING PRINT MEDIA

(71) Applicant: Hewlett-Packard Development Company, L.P., Fort Collins, CO (US)

(72) Inventors: Omer Gila, Cupertino, CA (US); Napoleon J. Leoni, San Jose, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 53 days.

(21) Appl. No.: 13/626,391

(22) Filed: Sep. 25, 2012

(65) Prior Publication Data

US 2014/0087295 A1 Mar. 27, 2014

(51) Int. Cl.
*G03G 15/00* (2006.01)

(52) U.S. Cl.
USPC ..... 430/32; 347/54

(58) Field of Classification Search
USPC ..... 430/32; 347/54
See application file for complete search history.

(56) References Cited

U.S. PATENT DOCUMENTS

| | | | | |
|---|---|---|---|---|
| 4,107,016 | A | 8/1978 | Brower, Jr. et al. | |
| 4,804,601 | A * | 2/1989 | Watson et al. | 430/32 |
| 6,850,724 | B2 | 2/2005 | Pang et al. | |
| 7,668,488 | B2 | 2/2010 | Guzman et al. | |
| 2006/0045572 | A1 * | 3/2006 | Hongawa et al. | 399/237 |
| 2010/0103437 | A1 | 4/2010 | Li | |
| 2011/0148976 | A1 * | 6/2011 | Takabayashi et al. | 347/19 |

FOREIGN PATENT DOCUMENTS

| | | |
|---|---|---|
| WO | 2012105948 | 8/2012 |

* cited by examiner

*Primary Examiner* — Peter Vajda
(74) *Attorney, Agent, or Firm* — Hewlett-Packard Patent Department

(57) ABSTRACT

Techniques for coating print media are described herein. In an example, a photo imaging assembly is to receive a liquid electrophoretic coating composition assembly on a chargeable surface so as to form a coating layer thereon using electrostatic forces. The coating layer is to be transferred to a print medium.

18 Claims, 6 Drawing Sheets

TECHNIQUES FOR COATING PRINT MEDIA

BACKGROUND

Print quality, ink adhesion, rub resistance, or durability are factors that designers and users of printers consider. Such advantages are, generally, in particular desired by commercial printing customers. One manner to improve image durability is to provide a coating on a print medium. The coating may be provided over the printed image printed, which is referred to as an overcoat. Alternatively, the coating may be provided onto the surface of the print medium, which is referred to as an undercoat. An image may be then subsequently printed on the coated print medium.

An undercoat may be applied to enhance fixation (e.g., bonding and/or hardening) of a colorant to be subsequently applied on the print medium. If the colorant includes an ink, fixation may be desired to address coalescence, bleed, feathering, or similar effects characterized by ink or pigment migration across a printed surface. An overcoat may be applied as a protection to improve durability of the printed image.

Some methods for applying coatings on a substrate include roll coating, spray coating, manual application, or treatment ejection, for example, through a jetting device.

BRIEF DESCRIPTION OF THE DRAWINGS

In order that the present disclosure may be well understood, various examples will now be described with reference to the following drawings.

DETAILED DESCRIPTION

Figure 1:
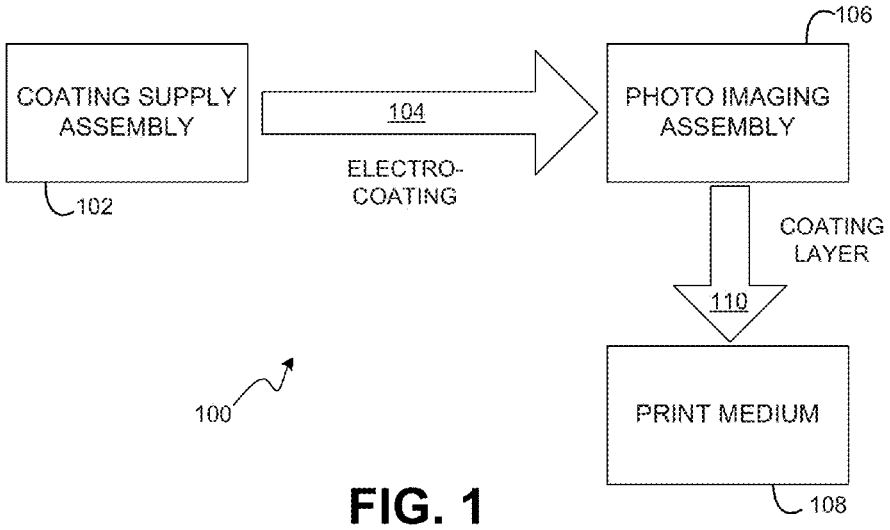
FIG. 1 shows a block diagram of a standalone coater according to examples.

In the following description, numerous details are set forth to provide an understanding of the examples disclosed herein. However, it will be understood that the examples may be practiced without these details. While a limited number of examples have been disclosed, it should be understood that there are numerous modifications and variations therefrom. Like numerals are used for like and corresponding parts of the various figures. While a limited number of examples are illustrated, it will be understood that there are numerous modifications and variations therefrom.

As set forth above, coating of print media, either as an undercoat or as an overcoat, is desired for a variety of print applications in order to improve print quality, ink adhesion, rub resistance, or durability of a printed image. In examples herein, a coating is provided by a standalone coater using a liquid electrophoretic coating composition. Thereby, it is facilitated a convenient manner of providing a coating on print media.

A liquid electrophoretic coating composition as used herein refers to a composition including a carrier liquid (e.g., a hydrocarbon oil) and an electrophoretic element comprised of a coating component, i.e., one or more coating components. In the following, a liquid electrophoretic coating composition is referred to as electro-coating. An electro-coating is to improve print quality, ink adhesion, rub resistance, or durability of a printed image pattern (i.e., a pattern for reproducing an image printed using a composition comprised of one or more colorants) on the print medium. More specifically, an electro-coating is characterized by being selected for providing an overcoat or an undercoat of a printed image that improves at least one characteristic of the printed image on the substrate.

Use of electro-coatings as described herein also facilitates providing coatings in an addressable manner so that portions of a print medium may be selectively coated. Coating units for providing addressable coatings are described below with respect to FIG. 5. However, an electro-coating as described herein may also be provided uniformly on a print medium.

A standalone coater as used herein is intended to encompass coaters in which a printing engine is configured to provide only a coating and not a printed image. This is in contrast to other systems in which a printing engine is used to provide colorant (e.g., ink) and coating on a substrate. For example, such other systems may be provided to supply ink and coating to the same chargeable surface of a photo imaging assembly (examples of photo imaging assemblies are described below). Thereby, standalone coaters as described herein may be built with a relatively simple configuration as compared to systems in which the printing engine is also to print an image pattern using one or more colorants. Thereby, cost per page of coated substrate might be kept relatively low while being able to provide a relatively good quality of a manufactured coating.

Some examples of standalone coaters are illustrated with respect to FIG. 1. FIG. 1 is a block diagram of a standalone coater 100 including a coating supply assembly 102, a photo imaging assembly 106 configured to coat a print medium 108. Coating supply assembly 102 is to supply an electro-coating 104 to photo imaging assembly 106. Photo imaging assembly 106 is to receive electro-coating 104 from coating supply assembly 102. More specifically, during operation of coater 100, electro-coating 104 is received on a chargeable surface (not shown in FIG. 1; see, e.g., chargeable surface 702*a* in FIG. 7) of photo imaging assembly 102 so as to form a coating layer 110 thereon. It will be understood that coater 100 may be comprised of further components for performing more specific functions. Some examples of further components of a coater are illustrated below.

Coating layer 110 is formed on the chargeable surface using electrostatic forces. In order to generate the electrostatic forces, generally, a voltage difference is imposed between the chargeable surface and an electro-coating applying element (e.g., a developer roller or an electrophoretic electrode). The coating layer may be formed according to some selected pattern. In such examples, the chargeable surface is charged in an addressable manner, as illustrated with respect to FIG. 3. In other examples, the coating layer is formed uniformly. In such examples, the chargeable surface may be charged uniformly. For example, a charging roller may be used to generate such uniform charging.

A coating supply assembly as used herein refers to an assembly suitable to supply electro-coating 104 to photo imaging assembly 106 so that coating layer 110 can be formed on a chargeable surface of photo imaging assembly 106 via electrostatic forces acting on the electro-coating. A coating supply assembly may be constituted by a binary coating developing unit configured to supply electro-coating through a developer roller, as illustrated with respect to FIG. 9. Alternatively, a coating supply assembly may be constituted by an electrophoretic electrode, as illustrated with respect to FIG. 10. Other types of coating supply assemblies are foreseen, for example, a spraying assembly that supplies electro-coating by spraying it onto the chargeable surface of the photo imaging assembly.

A photo imaging assembly as used herein refers to an assembly suitable to receive on a chargeable surface thereon a layer of electro-coating. In some examples, a photo imaging assembly includes a drum with a chargeable surface (see the examples below with respect to FIGS. 7 and 8). In other examples, a photo imaging assembly includes an endless belt with a chargeable surface to receive the electro-coating. The endless belt is supported by a plurality of cylinders.

The chargeable surface may be a surface of a dielectric layer on the drum. Such a dielectric layer may, for example, have a dielectric thickness between 1 and 10 μm or, more specifically, a dielectric thickness between 2 and 7 μm. Such a dielectric layer may have, for example, a dielectric constant between 3 and 10. Such a dielectric layer may, for example, be constituted by a glass coating (e.g., a Heraeus SD2000 coating) on a layer of anodized aluminum. Such a dielectric layer may be implemented in the photo imaging assembly as a hard surface coating, which constitutes a durable, non-consumable component of the coater. Such a dielectric layer might be charged, for example, with a corona unit, or an ion gun (such components are further illustrated below).

In other examples, the chargeable surface may be a surface of a photoconductor film attached to the surface of a supporting element of the photo imaging assembly (e.g., a supporting drum or an endless belt, as described above). Generally, the photoconductor film is configured as a replaceable element of the photo imaging assembly. The photoconductor film may be charged by a light beam as further described below.

There are a variety of manners of transferring coating layer 110 to the print medium. In some examples, illustrated below with respect to FIG. 7 coaters are configured to directly transfer coating layer 104 from the photo imaging assembly to the print medium. In other examples, illustrated below with respect to FIG. 8, coaters are configured to transfer coating layer 104 from the photo imaging assembly to the print medium through an intermediate transfer member.

Figure 2:
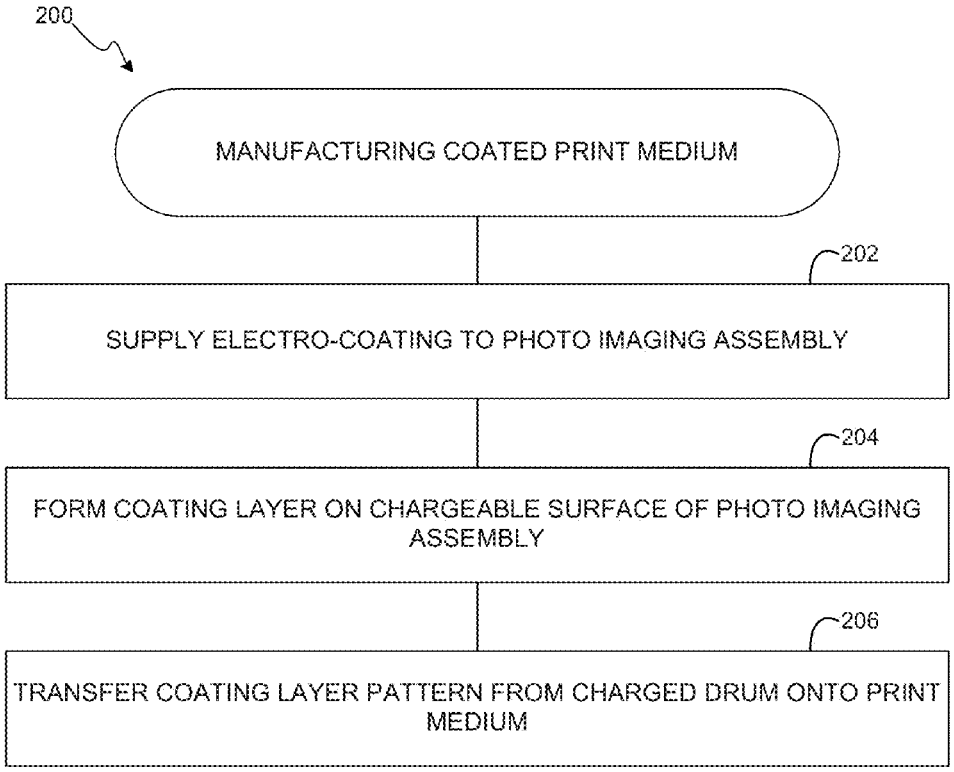
FIG. 2 is a flow diagram illustrating examples of operation of the standalone coater of FIG. 1.

FIG. 2 is a flow diagram 200 illustrating an example of operation of standalone coater 100 for manufacturing a coated print medium. At block 202, coating supply assembly 102 supplies electro-coating 104 to photo imaging assembly 106. At block 204, coating layer 104 is formed on the chargeable surface of photo imaging assembly photo imaging assembly 106. At block 206, coating layer 110 is transferred to print medium 108. As set forth above, coating layer 110 may be transferred directly or indirectly to print medium 108.

Figure 3:
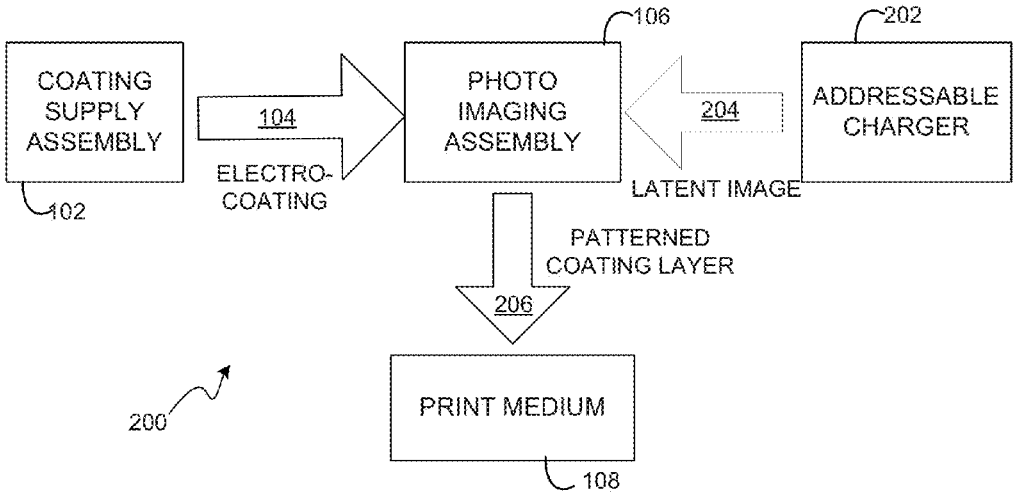
FIG. 3 shows a block diagram of a standalone coater for providing addressable coatings according to examples

In some examples herein, standalone coaters are configured to provide a digital coating layer, i.e., a coating that can be selectively applied to specific areas of a print medium. Such examples are illustrated with respect to FIGS. 3 and 4. FIG. 3 shows a block diagram of a standalone coater 300 for providing addressable coatings 302. Coater 300 includes a coating assembly 102 and a photo imaging assembly 106 analogous to those described above with respect to FIG. 1. In addition thereto, coater 300 further includes an addressable charger 202. Addressable charger 202 is to selectively charge areas on a chargeable surface of photo imaging assembly 106. Thereby, a coating layer can be formed on the photo imaging assembly according to a selected pattern.

Charger 202 may be operatively coupled with a raster image processor (not shown) to receive a raster pattern corresponding to a desired pattern of the coating on the print medium. Charger 202 may be configured to translate the received raster pattern on a latent image 204 on the chargeable surface of photo imaging assembly 106. Latent image 204 is comprised of the selective charges imposed by charger 202.

There are a variety of options for implementing addressable chargers. Generally, application of digital coatings does not require a resolution as high as the resolution to be provided for printing an image. For example, in some applications, addressability of the coating layer is to prevent coating of some specific areas which are relatively big as compared to the resolution limit of a printer for printing image patterns in commercial printing. For example, in an application, substrate edges are to remain uncoated. In other example applications, areas to receive adhesive are to remain uncoated (this can be in particular be the case for packaging applications).

This means that a coater as described herein may be configured relatively simply as compared to printing engines for printing image patterns. For example, such low resolution constraints facilitates a simplifying of the raster image processor for indicating areas of printing media to be coated as well as configuration of the addressable charger. In some examples, the standalone coater is configured to provide a resolution of at least 2 mm or, more specifically, 1 mm or, even more specifically, 0.5 mm. For example, a resolution of 1 mm might be sufficient for a digital coating, which corresponds to 25 dpi (dots per inch). This is to be compared to a resolution of about 800 dpi provided by some digital presses (e.g., an Indigo Digital Printing Press). This means an approximately 1000× simplification in the provision of a digital coating in comparison to the provision of a printed image pattern.

In some examples, the addressable charger is comprised of an addressable ion head. An addressable ion head includes one or more charge generating matrix sets that emits charges. The emitted charges are to be received by the chargeable surface of the photo imaging assembly so that a latent image can be formed thereon. A more detailed description of an addressable ion head that may be used to implement charger 202 may be found in U.S. Pat. No. 6,081,286, which is incorporated herein by reference in its entirety (to the extent in which this document is not inconsistent with the present disclosure) and in particular those parts thereof describing apparatuses for generating electrostatic charge images on a receptor surface. Ion guns facilitate a high addressability.

In other examples, the addressable charger is comprised of a corona unit with an addressable grid. Examples of such corona units that may be used to implement charger 202 may be found in U.S. Pat. No. 4,918,002, which is incorporated herein by reference in its entirety (to the extent in which this document is not inconsistent with the present disclosure) and in particular those parts thereof describing addressable charging. Ion guns and corona units are particularly suited for addressably charging photo imaging assemblies with a dielectric chargeable surface. Addressable corona units facilitate addressably charging that results in a relatively simple device which can be conveniently manufactured and operated. Further, an addressable corona might deliver a sufficiently high resolution.

In examples in which the chargeable surface corresponds to the surface of a photoconductor film, an addressable charger may be constituted of a scanning light imager configured to direct light upon the photoconductor. For example, such a scanning light imager may include a scanning laser which is moveable on the photoconductor film as it translates beneath the imager. Those portions of the photoconductor film which are impinged by the light discharge the background electrostatic charge to form a latent image upon its surface. The portions of the photoconductor that are not impinged by the laser maintain their respective background electrostatic charge.

It will be understood that addressable chargers are not limited to the above example and they encompass any charger device suitable to selectively charge areas on a chargeable surface of the photo imaging assembly.

Figure 4:
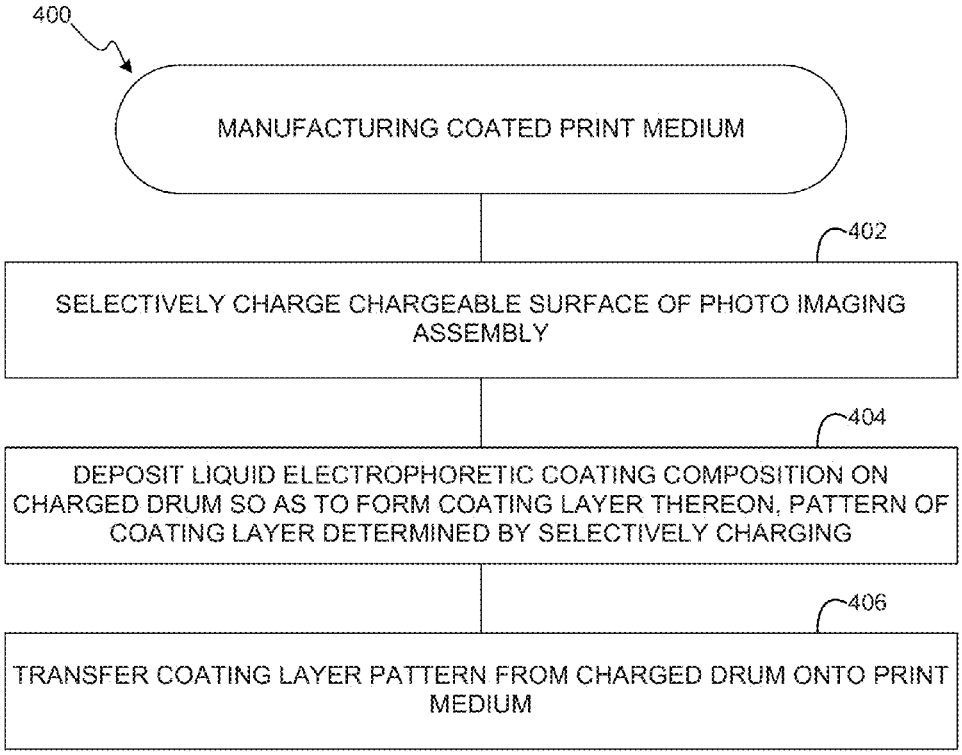
FIG. 4 shows a flow diagram illustrating examples of operation of the standalone coater of FIG. 9.

FIG. 4 is a flow diagram 400 illustrating an example of operation of standalone coater 300 for manufacturing a coated print medium. At block 402, addressable charger 202 selectively charges a chargeable surface of photo imaging assembly 106. Latent image 204 is formed on the chargeable surface. At block 404, coating supply assembly 102 deposits electro-coating 104 on the charged surface of photo imaging assembly 106 so as to form a coating layer thereon. Block 404 may be implemented analogously as block 204 described above with respect to FIG. 2. At block 404, the pattern of the coating layer is determined by the selectively charging at block 402. At block 406, a patterned coating layer is transferred from the charged drum to print medium 108. Block 406 may be implemented analogously as block 206 described above with respect to FIG. 2.

A standalone coater according as described herein may be a system dedicated to coating independent from a print system. More specifically, a standalone coater may be constituted as a system that is not suitable to print image patterns, but just for providing coatings as described herein. Image patterns might be (previously or subsequently) printed by an image print system physically separated from the standalone coater. Systems dedicated to coating may be of particular advantage for providing a dedicated coating system that manufacture coated substrates at a relatively low cost with a relatively high quality. In particular, as evidenced by examples herein, electro-coatings may be provided with a simplified printing engine. Further, a dedicated coater allows flexibility in the manufacturing of coated substrates.

In alternative examples, the coater is a standalone unit in an image printing system. In other words, a standalone coater may be integrated as a coater inline unit in an image printing system. An example of a printing system including a standalone coating unit is illustrated below with respect to FIG. 5. Integrating a coating unit in an image printing system as described herein facilitates increasing versatility of the printing system for providing a coating with a relatively high quality and a relatively simple, standalone, printing engine for providing the coating.

Figure 5:
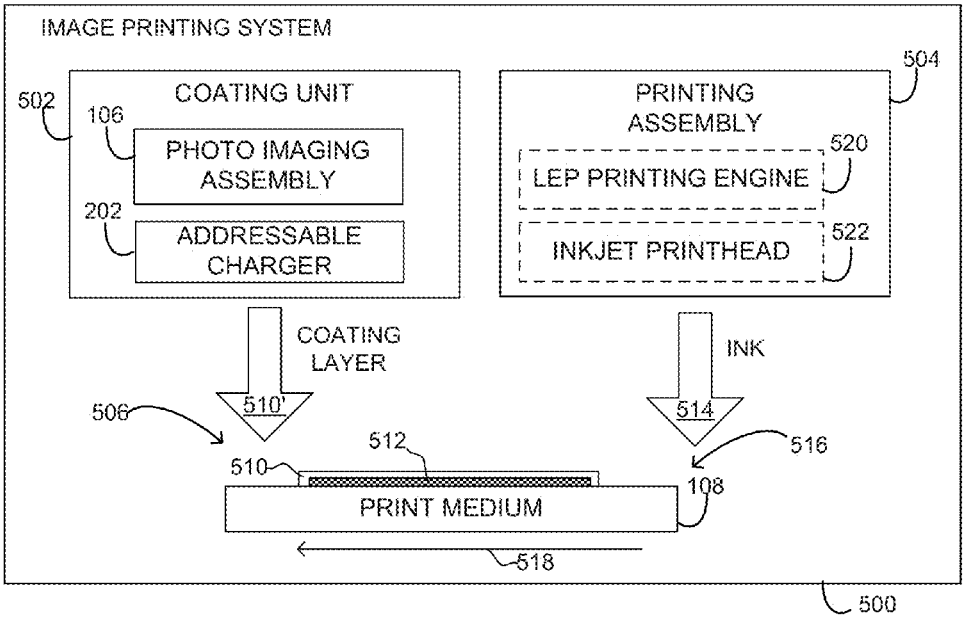
FIG. 5 shows a block diagram of a printing system including a standalone coating unit according to examples herein.

FIG. 5 is a block diagram of an image printing system 500 including a standalone coating unit 502 according to examples herein and a printing assembly 504. Image printing system 500 is to provide a print medium 108 with a coating layer 510 and an image pattern 512.

Coating unit 502 includes a photo imaging assembly 106 and an addressable charger 202, which might be constituted analogously as the photo imaging assemblies and addressable chargers described above with respect to FIGS. 1 and 3. More specifically, photo imaging assembly 106 is to receive a liquid electrophoretic coating composition on a chargeable surface; addressable charger 202 is to selectively charge areas on the chargeable surface in a manner such that a layer of electro-coating can be formed on the photo imaging assembly according to a selected pattern. Image printing system 500 further includes a coating transfer area 506 in which the patterned coating layer 510' is to be transferred over print medium 108.

Printing assembly 504 is to selectively deposit colorant 514 on the print medium so as to form image pattern 512 on print medium 108. More specifically, image printing system 500 further includes a colorant transfer area 516 in which ink is deposited on print medium 108 so as to form image pattern 512 thereon. Since coating unit 502 and printing assembly are implemented as standalone units in image printing system 500, coating transfer area 506 and colorant transfer area 516 are spaced from each other.

According to examples, print medium 108 is translated between printing assembly 504 and coating unit 502 for sequentially providing coating layer 510 and image pattern 512. Depending on the direction of translation, coating unit 502 is to provide an overcoat or an undercoat on print medium 508. In the illustrated example, print medium 106 is translated from printing assembly 504 to coating unit 502, i.e. along direction 518. Thereby, coating layer 510 is provided as an overcoat on image pattern 512. Analogously, print medium 108 might be translated from coating unit 502 to printing assembly 104, so that a coating layer can be provided as an undercoat of the printing pattern.

Printing assembly 504 may be constituted by any suitable print engine suitable to form image pattern 512. In some examples, printing assembly is to selectively deposit colorant by liquid electrophoretic (LEP) printing. LEP printing refers to printing using the principles of digital offset color technology. More specifically, printing assembly 504 may include a liquid electrophoretic (LEP) printing engine 520. LEP printing engine 520 may be to create a printed image from digital data by forming an inked image on a photo imaging assembly using a LEP ink, transferring the inked image to a blanket element, and transferring the inked image from the blanket element to a substrate held by an impression element. Indigo Digital Printing Presses are examples of LEP printers. Combining a stand-alone coating unit with a LEP printer as standalone units facilitate a simple integration of coating an LEP printing in a single unit. Further, no modification in the LEP printing engine of the LEP printer is required.

According to some examples, printing assembly 504 is to selectively deposit ink by inkjet printing. For example, printing assembly 504 may include an inkjet printhead 522. There are a variety of manners of configuring inkjet printhead 522 for inkjet printing an image. In some examples, inkjet printhead 522 is mounted on a movable carriage. During printing, the carriage traverses over the print medium for printing a portion of the image equivalent to a printhead swath.

In other examples, inkjet printhead 522 includes a full-width inkjet nozzle array. For example, the full-width inkjet nozzle array may constitute a printhead that spans the whole portion of the substrate to be printed. During printing, nozzles in a page wide array printhead are selectively fired to reproduce the image on the substrate. Such full-width inkjet presses are particularly convenient for industrial printing since they may achieve a higher productivity than scanning printheads. HP inkjet web presses are examples of such full-width inkjet presses. Coaters described herein might be particularly convenient for such industrial presses, since print quality, ink adhesion, rub resistance, or durability are factors that are particularly desirable in industrial printing. Further, combining a stand-alone coating unit with a full-width inkjet press as stand-alone units facilitate a simple integration of coating an industrial printing in a single unit, since a coater as described herein might be provided in a relatively simple configuration.

It will be understood that there are a plurality of manners of configuring printing assembly 504 and is not limited to the above examples. For example, printing assembly 504 may be a xerography apparatus for using a dry toner composition. Further, the constitution of colorant 514 generally depends on the used print engines. As used herein, a colorant refers to a composition suitable for reproducing an image when applied on a substrate. Examples of such a colorant are inks or dry toner. An ink, as used herein, refers to a liquid or paste that contains pigments or dyes and is usable to reproduce an image on a substrate via printing. Toner, as used herein, refers to a powder usable to reproduce an image on a substrate via xerography.

Figure 6:
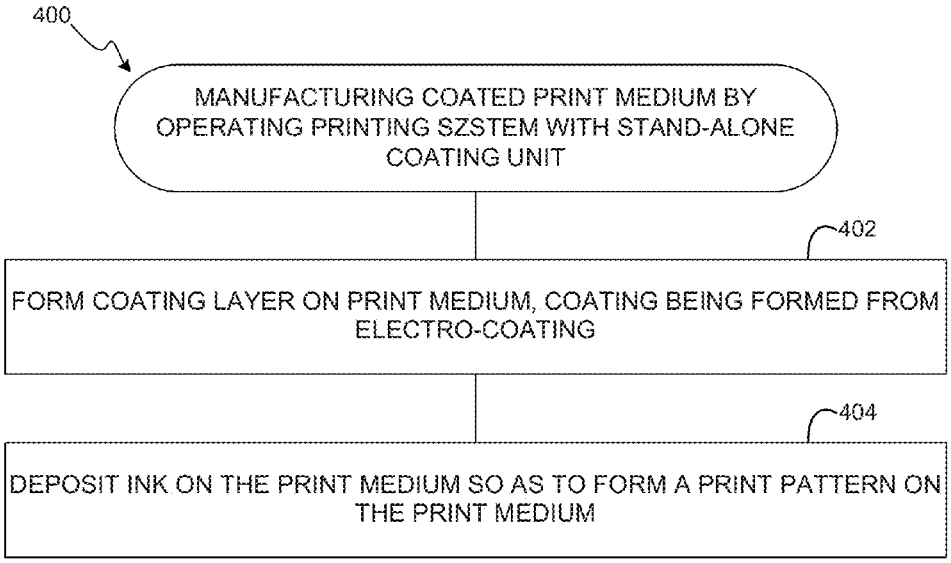
FIG. 6 shows a flow diagram illustrating examples of operation of the printing system of FIG. 5.

FIG. 6 is a flow diagram 600 illustrating examples of operation of image printing system 500 shown in FIG. 5. At block 402, coating layer 510 is formed on print medium. Coating layer 512 is formed from electro-coating. Block 402 may be implemented using any of the flow diagrams illustrated above with respect to FIGS. 2 and 4, wherein the coater is integrated in a printed system. At block 404, ink 514 is deposited on print medium 106 so as to form image pattern 512 on print medium 106. As set forth above, ink 514 may be deposited using a variety of print methods such as, but not limited to, inkjet printing, or electrographic printing. Depending on the order of execution of blocks 402 and block 404, coating layer 510 is an overcoat or an undercoat: if block 402 is executed firstly, coating layer 510 is an undercoat disposed between print medium 106 and image pattern 512; in contrast thereto, if block 404 is executed firstly, coating layer 510 is an overcoat disposed onto image pattern 512.

In the following more specific examples of implementation of coaters 100, 300, 502 are illustrated with respect to FIGS. 5 to 11. It will be understood that the following examples, although depicted independently from a printing system, could also be integrated in an image printing system as illustrated above.

According to some examples herein, a coater is configured to directly transfer the coating layer from the photo imaging assembly to the print medium. Such examples are illustrated with respect to FIG. 7, which shows a block diagram of a standalone coater 700. Coater 700 is illustrated as including a photo imaging assembly 106 comprised of an imaging drum 702, a charging unit 704, a coating supply assembly 102, a heating unit 706, a cleaning station 708, and a charge erase station 710.

Imaging drum 702 is comprised of a rotatable drum, which is configured to rotate in direction 712 so that the different processes described below for forming a coating layer 110 can be carried out on its surface 702*a* in the appropriate sequence. Surface 702*a* is a chargeable surface, which might be implemented using, for example, a dielectric material or a photoconductor, as set forth above with respect to FIG. 1.

Charging unit 704 may be implemented analogously as described above with respect to addressable charger 202. In other examples, charging unit 704 is not addressable. For example, it might be constituted of a charging roller to generate a uniform charging on surface 702*a*. A coater including a not addressable unit 704 is generally desirable for applications that merely require a uniform coating of a substrate.

Heating unit 706 is to promote transferring of a coating layer 110 formed onto surface 702 of imaging drum 702 to print medium 108. For example, heating unit 706 is to heat photo imaging assembly 106, or more specifically surface 702*a* of imaging drum 702, so that the temperature difference between the photo imaging assembly and the print medium promotes transfer of the coating layer 110 on print medium 108. Further, heating electro-coating may also induce that the coating layer becomes tacky, which might further promote transferring. Heating unit 706 may be to heat coating layer 110 while being carried by imaging drum 702. For example, heating unit 706 may be to heat surface 702*a* of imaging drum 702 to approximately 100° C. to i) dry/evaporate at least a portion of the carrier (e.g., an isoparaffin oil) and ii) to cause coating carrying particles of the electro-coating to melt and blend into a smooth liquid plastic before reaching a further transfer area 506, in which surface 702*a* of imaging drum 702 contacts print medium 108. When heated coated layer 110 on imaging drum 702 contacts the cooler surface of print medium 108, the electro-coating solidifies, adheres, and transfers to print medium 108. In some examples, a heating unit may be combined with a condenser to receive a condensate carrier liquid from the electro-coating.

Figure 7:
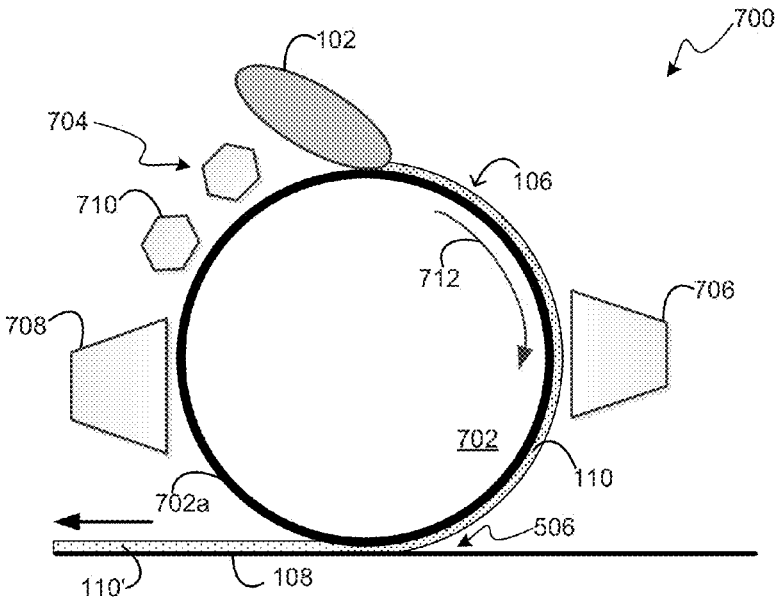
FIG. 7 shows a block diagram of a standalone coater according to examples.
Figure 8:
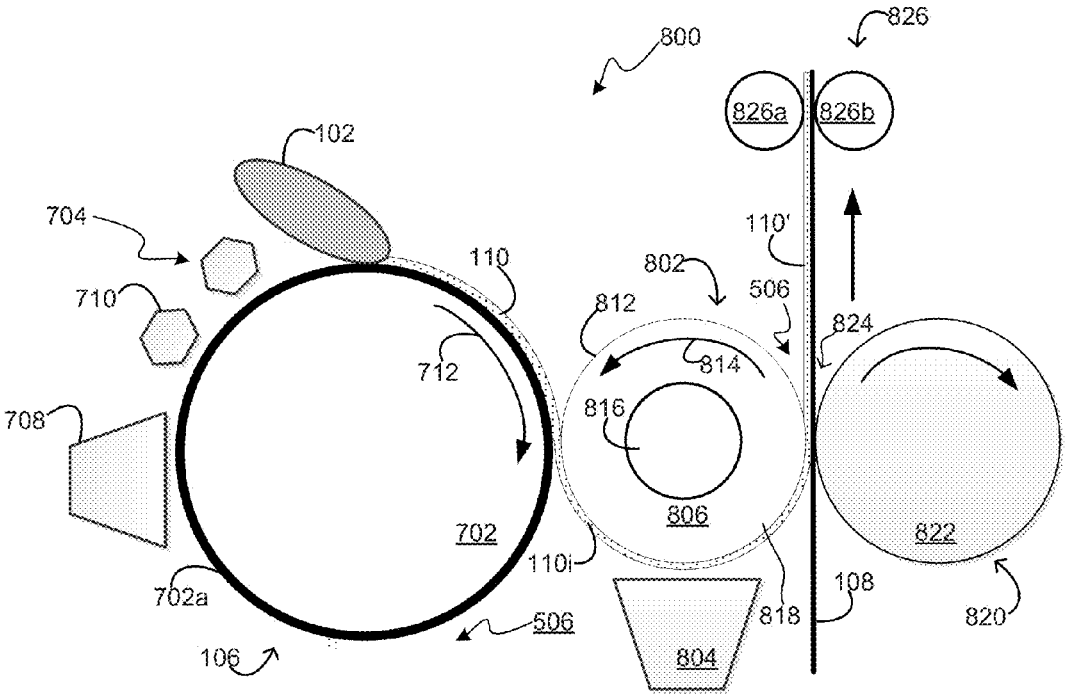
FIG. 8 shows a block diagram of a standalone coater according to examples.

Heating unit 706 is an example of heating unit that might be implemented in heaters described herein to promote transfer of the coating layer to the print medium. There are different alternative locations for heating the electro-coating. In the example of FIG. 7, heating unit 706 heats the electro-coating on imaging drum 702. In the example of FIG. 8 (illustrated below), heating unit 804 heats electro-coating on transfer drum 806. Moreover, a heating unit might be implemented as an external heater (see examples of FIGS. 7 and 8). In other examples, heating units might be implemented as an internal heater. Internal and external heaters may also be combined in the same system.

The illustrated heating unit 706 is shown to be disposed externally to chargeable surface 702*a* of imaging drum 702. Such external heating units may include further components for implementing external heating such as, but not limited to, radiation heating systems (e.g., an IR heater), air knifes, as well as air suction for collecting evaporated components of the electro-coating. In alternative examples, heating unit 706 is comprised of a heating system embedded into imaging drum 702 and configured to heat its surface 702. Such an embedded heating unit may be comprised of an IR heater or of an array of electrical heating elements. Such an embedded heating unit may be combined with an external airflow generation system and condenser for collecting evaporated components of the electro-coating.

Cleaning station 708 is to clean a portion of the photo imaging assembly in an area downstream from the area in which the coating layer is transferred from the photo imaging assembly. More specifically, cleaning station 708 is to remove residual electro-coating from surface 702*a* of imaging drum 702. Cleaning station 708 is disposed proximate to surface 702*a* and between transfer area 506 and charge erase station 710. Cleaning station 708 is disposed downstream of charging unit 704 and coating supply assembly 102 to facilitate formation of a new coating layer on imaging drum 702. Cleaning stations may be comprised of a combination of a blade and a wet sponge (both elements not shown) in order to collect and accumulate residual electro-coating on surface 702*a*.

Charge eraser 710 is to remove residual charge from surface 702*a*. In the illustrated example charge eraser 710 is disposed along chargeable surface 702*a* of imaging drum 702. Further, in the example, charge eraser 710 is disposed proximate to surface 702*a* and between cleaning station 708 and charging unit 704. Charge eraser 710 is disposed downstream of charging unit 704 to facilitate appropriate charging of imaging drum 702 so as to promote formation of coating layer 106 on its surface 702*a*. In examples in which chargeable surface 702*a* forms part of a dielectric layer, charge eraser 710 may be comprised of an AC corona or an AC Charge Roller unit. In examples in which surface 702*a* forms part of a photoconductor layer, charge eraser 710 may be implemented by a light-emitting diode (LED) erase lamp.

According to some examples herein, a coater is configured to indirectly transfer the coating layer from the photo imaging assembly to the print medium. For example, the coating layer can be transferred to the print medium via an intermediate transfer member. The intermediate transfer member effects an offset printing of the coating layer on the print medium. Such examples are illustrated with respect to FIG. 8. An intermediate transfer member may be particularly advantageous for coating rough print media (e.g., print media with roughness above 0.5 μm or, more specifically, above 1 μm). An intermediate print member facilitates resilient contact with the print medium surface so that the transfer surface can better conform to the print medium surface.

FIG. 8 shows a block diagram of a standalone coater 800 according to examples. Coater 800 is illustrated as including a photo imaging assembly 106 comprised of an imaging drum 702, a charging unit 704, a coating supply assembly 102, a cleaning station 708, and a charge erase station 710, which are constituted similarly as set forth above with respect to FIG. 7. In addition thereto, coater 800 includes i) an intermediate transfer member 802, comprised of an intermediate drum 806, and ii) a heater unit 804 disposed to heat intermediate transfer drum 802.

Intermediate transfer member 802 is to transfer coating layer 110 from photo imaging assembly 702 to print medium 108. Thereby, an intermediate coating layer 110*i* is formed on drum 806 in its section comprised between an intermediate transfer area 808 (in which electro-coating is transferred between imaging drum 702 and intermediate drum 806) and a transfer area 506 (in which electro-coating is transferred between intermediate drum 806 and print medium 108 so as to form coating layer 110' thereon). Intermediate drum 806 is rotatable. In the illustrated example, during operation of coater 800, intermediate drum 806 rotates along direction 814 (opposite to the direction of rotation of imaging drum 702) so that electro-coating can be conveyed from imaging drum 702 towards print medium 108.

Intermediate transfer member 806 includes an exterior transfer surface 812, which may be resiliently compressible and/or may be electrostatically chargeable. A transfer surface 812, which is resiliently compressible facilitates that surface 812 conforms and/or adapts to irregularities on print medium 108. Additionally, because surface 812 is configured to be electrostatically charged, surface 812 may be charged to a voltage to facilitate the transfer of electro-coating from the surface 702 of imaging drum 702 to the transfer surface 812. In some examples, transfer surface 812 has a compressibility that reduces the likelihood of damage caused by permanent deformation of surface 812.

Intermediate coating layer 110*i* may be dried and heated by heating unit 804 before transfer to substrate 108. Further, heating unit 804 may include a hot air knife to direct hot air on the surface of transfer drum 806. Alternatively, or in addition to heating unit 804, transfer drum 806 may include an internal heating unit (not shown) which heats the surface 812 for promoting transfer of intermediate coating layer 110*i*. Such an internal heating unit may heat surface 812 to a temperature between 70 and 150 degrees.

In the illustrated example of FIG. 8, intermediate transfer member 802 includes a drum 816 and an external blanket 818. Drum 816 in this example is a cylinder that supports blanket 818. The cylinder may be constructed using material(s) having a relatively low thermal conductivity and/or heat resistance. Blanket 818 in the illustrated example wraps about drum 816 and includes surface 812. Blanket 818 may be constructed using a resiliently compressible layer and an electrically conductive layer, which facilitates transfer surface 812 to conform on the print medium surface and to be electrostatically charged. In some alternative examples, intermediate transfer member 802 includes an endless belt supported by a plurality of cylinders, including a transfer cylinder, in contact and/or in close proximity to chargeable surface 702 and the print medium 108 (or the area configured to support the print medium such as an impression cylinder).

Heating unit 804 is to heat intermediate transfer member 802. Heating unit 804 is configured in a manner that the temperature difference between the intermediate transfer member and the print medium promotes transfer of the coating layer on the print medium. Heating unit 804 may be configured analogously as heating unit 706, with the exception that it is configured to operate on intermediate transfer member 802.

In some examples, as illustrated in FIG. 8, coaters as described herein further includes an impression member 820 to support print medium 108 against the element of the coater from which coating 110 is being transferred. In the example of FIG. 8, impression member 820 is comprised of an impression cylinder 822. The example impression cylinder 822 of FIG. 8 is a cylinder located adjacent to intermediate transfer member 802 so as to form a nip 824 between intermediate transfer member 802 and cylinder 822. During operation of coater 800, print medium 108 is fed between intermediate transfer member 802 and impression cylinder 822. Intermediate coating layer 110*i* is transferred from intermediate transfer member 802 to print medium 814 at nip 824. Although impression member 820 is illustrated as a cylinder, it may alternatively be implemented using an endless belt and/or a stationary surface against which intermediate transfer member 802 moves. An analogous impression member may be implemented in the example of FIG. 7 to held print medium 108 against imaging drum 702.

In some examples herein, a stand-alone coater further includes a fuser device to heat the coating layer on the print medium. FIG. 8 shows, as an example, fuser 826 comprised of two rollers 826*a*, 826*b*, through which print medium 108, after receiving coating layer 110' can be fed. At least one of rollers 826*a*, 826*b* might include a heating element in order to heat coating layer 110' on print medium 108. Thereby, it is facilitated to improve adhesion of coating layer 110'.

It will be understood that the configuration of elements in standalone coater 800 is merely illustrative. For example, the whole processing illustrated with respect to FIG. 7 and FIG. 8 may be rotated counter-clockwise 90 to 270 degree in order to simplify coating supply assembly 102.

In the examples above, reference is made to a coating supply assembly. As set forth above, there is a variety of manners of constituting a coating supply assembly. According to some examples, illustrated with respect to FIG. 9, a coating supply assembly includes a developer roller. The developer roller is to receive a layer of electro-coating to be supplied to the photo imaging assembly. The electro-coating is supplied from the developer roller by the electrostatic forces due to a voltage difference between the developer roller and the chargeable surface in the photo imaging assembly.

Figure 9:
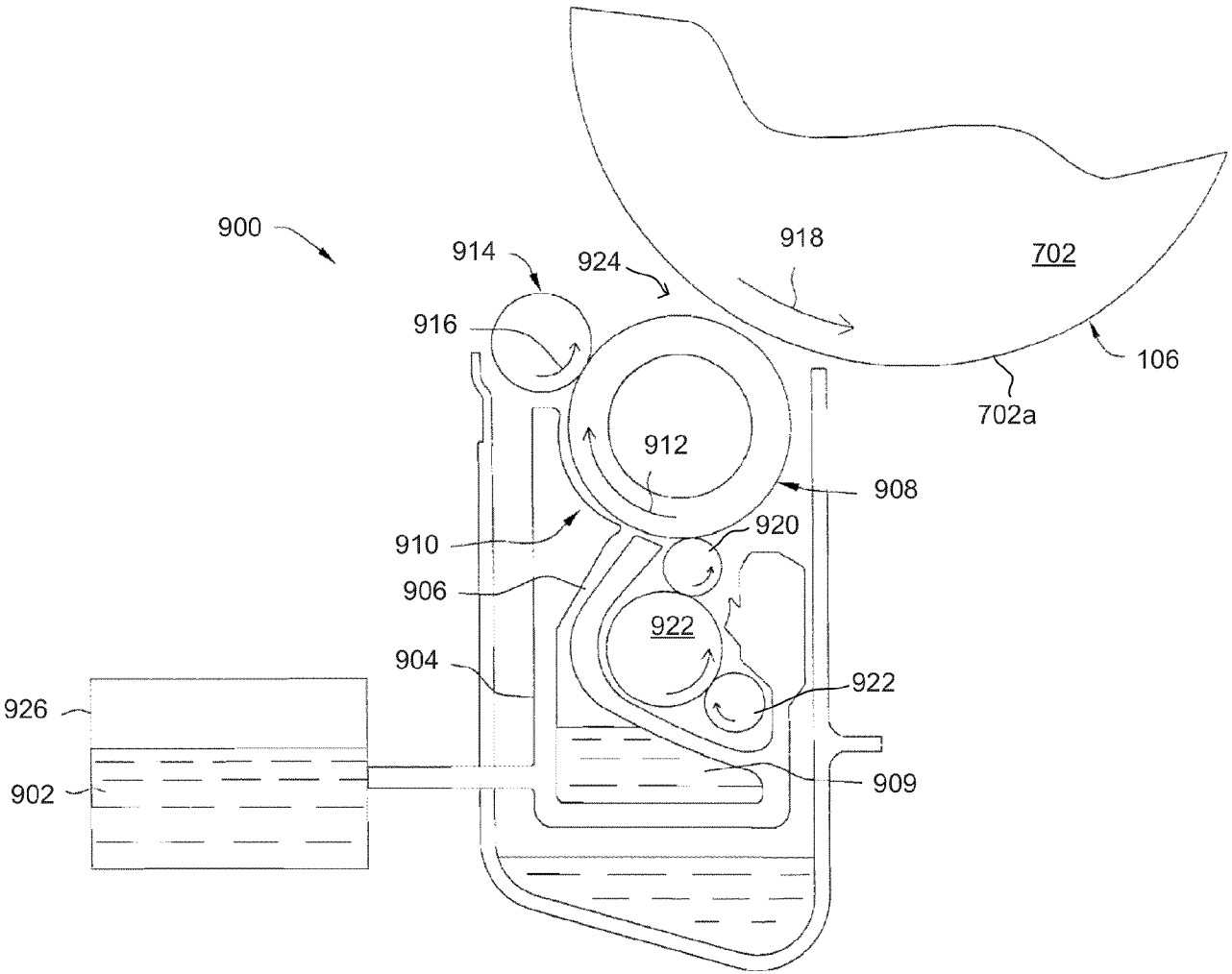
FIG. 9 is a partial cut-away view of a binary coating developer of a coater according to examples.

Such a developer roller may be implemented as a binary coating developer unit as specifically illustrated with respect to FIG. 9. A binary coating developer unit may be implemented analogously to a binary ink developer unit as described in U.S. Pat. Nos. 5,596,996 or 5,610,694, which are incorporated herein by reference in its entirety (to the extent in which these documents are not inconsistent with the present disclosure) and in particular those parts thereof describing units for developing a liquid composition comprised of chargeable particles.

FIG. 9 is a partial cut-away view of an example of a binary coating developer (BCD) 900 of a coater based on electrocoatings as illustrated above with respect to FIGS. 1 to 8. BCD 900 is associated to imaging drum 702 of photo imaging assembly 106, which may be constituted as described above with respect to FIG. 7 or 8. A tank 926 is connected to BCD 900. Electro-coating 902 in tank 926 may be transported to BCD 900 as described in greater detail below.

BCD 900 may further include a reservoir 904 that stores electro-coating 909. Electro-coating 909 may be pumped to reservoir 904 from tank 226. A channel 906 extending from reservoir 904 enables electro-coating 909 to flow to a developer roller 908. Electro-coating from developer roller 908 transfers to imaging drum 702 by way of electrostatic forces.

More specifically, developer roller 908 includes a main electrode 910 associated therewith that serve to electrically charge electro-coating 909. Main electrode 902 is sometimes referred as the first electrode. A development voltage is applied between main electrode 902 and developer roller 908 to generate an electric current to charge electro-coating 909. Thereby, in response to the electric current, a layer of electro-coating can be formed onto developer roller 908. This electro-coating layer is, generally, a function of the development voltage applied by main electrode 910 relative to developer roller 908. The electro-coating layer is to be transferred onto imaging drum 702 at a transfer region 924 according to an electrostatic latent image formed on imaging drum 702 as illustrated above with respect to FIG. 2.

Developer roller 908 rotates in a direction 912 as viewed from FIG. 9. As described in greater detail below, the rotation of developer roller 908 and the electric field applied between developer roller 908 and main electrode 910 enable electro-coating 909 charged by main electrode 910 to be applied to developer roller 908. In addition, the rotation enables electro-coating to be removed from developer roller 912 and applied to imaging drum 702 as described in greater detail below. An additional transfer member (not shown) may also be provided between developer roller 912 and chargeable surface 702*a* of imaging drum 702.

BCD 900 further includes a squeegee electrode 914. Squeegee electrode 914 is configured as a roller that, in operation, rotates in a direction 916 as viewed from FIG. 9. Direction 916 is opposite direction 912 (rotation direction of developer roller 908). A voltage may be applied between squeegee electrode 914 and developer roller 908. For example, squeegee electrode 914 may be electrically connected to a voltage supply (e.g., voltage supply 106, depicted in FIG. 1). The rotation of squeegee electrode 914 and the voltage applied to the squeegee electrode 914 facilitates further charging electro-coating on a section of developer roller 908 passing beneath squeegee electrode 914.

In some examples, BCD 900 may further include a cleaner roller 920 adjacent to developer roller 908 at a region downstream (relative to the rotation direction 912 of developer roller 908) of an electro-coating transfer region 924. Cleaner roller 920 is to clean any excess electro-coating remaining on a section developer roller 908 after transferring electro-coating from that section onto imaging drum 702. Cleaner roller 920 may collaborate with further rollers 922 for conveying excess electro-coating back to reservoir 904. Thereby, excess electro-coating may be re-utilized for forming further electro-coating development layers onto development roller 908.

Figure 10:
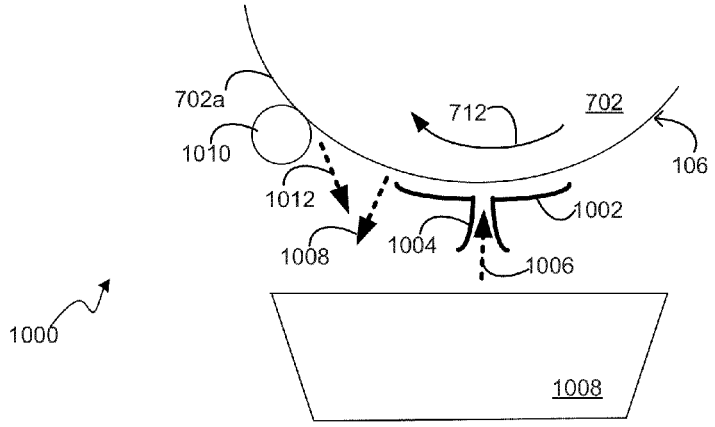
FIG. 10 shows a partial block diagram of a standalone coater according to examples.

It will be understood that coating supply assemblies are not limited to systems based on developer rollers. For example, but not limited to, coating supply assemblies may be comprised of an electrophoretic electrode as illustrated with respect to FIG. 10. FIG. 10 shows a partial block diagram of a standalone coater 1000 according to examples. Coater 1000 includes an electrophoretic electrode 1002. Electrophoretic electrode 1002 is shown as a fixed electrode disposed in the proximity of imaging drum 702. Electrode 1002 is shaped to partially conform surface 702*a* of drum 702. Electrode 1002 includes a channel 1004 through which electro-coating 1006 can be fed into the space formed between electrode 1002 and surface 702*a*. Electro-coating 1006 may be fed from a catch tray 1008.

A voltage difference between electrode 1002 and surface 702 generates electrostatic forces that promote flowing of electro-coating towards surface 702. Further, charges on surface 702 promotes that electro-coating adheres thereto so as to form a coating layer thereon. If charges on surface 702 have been created in an addressable manner, the coating layer is formed according to a selected pattern.

During operation, as imaging drum 702 rotates along direction 712, electro-coating is distributed across surface 702*a*. Residual electro-coating 1008 may flow back from electrode 1002 into catch tray 1008. A squeegee unit 1010 may be disposed upstream from electrode 1002 to compact the coating layer formed on imaging drum 702 and/or remove any excess electro-coating 1012. Excess electro-coating 1012 may flow back from squeegee unit 1010 into catch tray 1008. Squeegee unit 1010 may be comprised, for example, of a squeegee roller configured to rotate against surface 702*a* of imaging drum 702.

Figure 11:
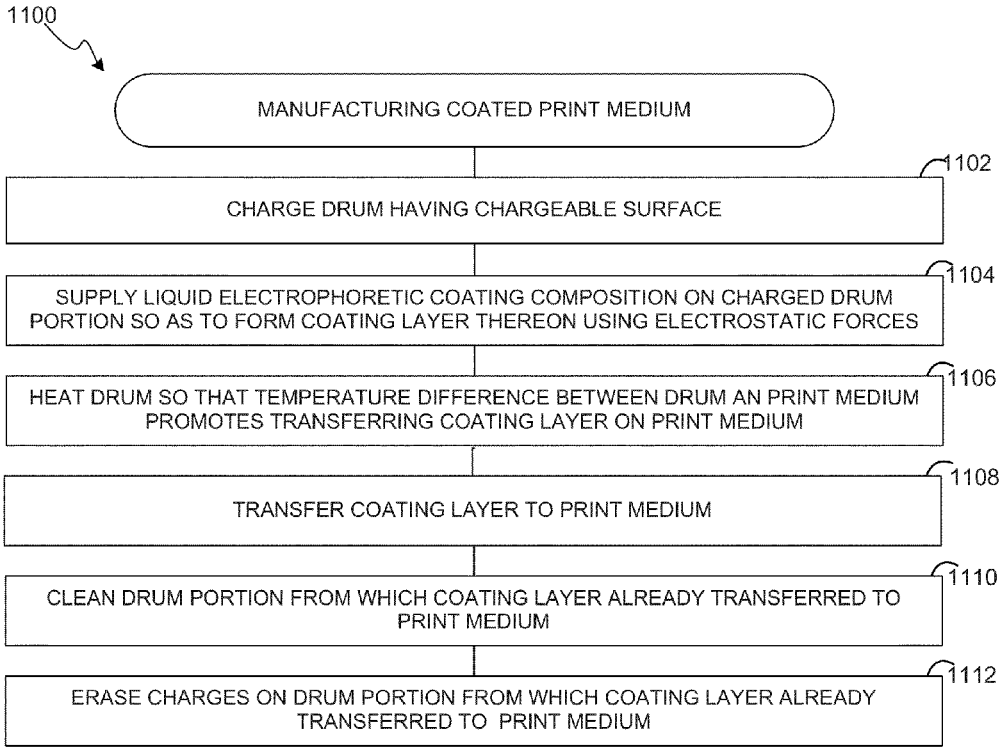
FIG. 11 shows a flow diagram illustrating examples of operation of the standalone coaters of FIGS. 7 and 8.

FIG. 11 is a flow diagram 1100 illustrating an example of operation of any of standalone coaters 700 or 1100 for manufacturing coated print medium 108 illustrated above with respect to FIGS. 7 and 8. At block 1102, charging unit 704 charges imaging drum 702 and, more specifically, its chargeable surface 702. At block 1104, coating supply assembly 102 supplies electro-coating on a charged portion of imaging drum and, more specifically, at a charged portion of chargeable surface 702*a*.

At block 1106, heating unit 706 heats imaging drum 702. Imaging drum 702 is heat so that the temperature difference between imaging drum 702 (and more particularly, its surface 702*a*) and print medium 108 promotes transfer of coating layer 110 from surface 702*a* to print medium 108. Thereby, a coating layer 110' is formed on the surface of print medium 108 facing imaging drum 702.

At block 1108, coating layer 110 is transferred at transfer area 506 to print medium 108 so as to form coating layer 110'. The manner in which coating layer 110 is transferred at transfer area 506 depends on whether coating layer 110 is transferred directly or indirectly to print medium 108. For example, looking at FIG. 8, it can be understood that block 1108 may be implemented by a direct transfer from surface 702*a* of imaging drum 702 to print medium 108. This approach facilitates a simpler implementation of the coater, which might be particularly appropriate for substrates with relatively low roughness. Looking at FIG. 9, it can be understood that block 1108 may be implemented by an indirect transfer from surface 702*a* of imaging drum 702 to print medium 108 via intermediate transfer member 802. This approach is a more complex implementation of the coater, however it facilitates that the coating layer is appropriately transferred on the surface of print medium 108. This might be particularly appropriate for substrates with relatively high roughness.

It will be understood that the composition of coating layer 110 on surface 702 and coating layer 110' disposed on print medium 108. For example, coating layer 110 may still include carrier components that are evaporated at the heating stage. Those components are, at least partially, not transferred to print medium 108 as part of coating layer 110'.

Coated print medium 108 may be fed into transfer area 506 with a blank surface or with an image pattern already printed thereon. In the former examples, coating layer 110 is an undercoat for subsequent image printing thereon. In the latter examples, coating layer 110 is an overcoat to cover the image pattern (see, e.g., the illustrated example in FIG. 5).

Referring back to FIG. 11, at block 1110, cleaning station 7011 cleans a portion of imaging drum 702 from which coating layer 110 has already been transferred to print medium 108. Further, cleaning is performed before that drum portion is re-charged or re-supplied with electro-coating. At block 1110, charge erase station 710 erase charges on a portion of imaging 702 from which coating layer 110 has already been transferred to print medium 108. As in the illustrated example of FIG. 11, it might be advantageous to erase charges on a drum portion on which cleaning station 708 has already removed residual electro-coating.

Subsequently to a process as exemplified by flow diagram 1100, coated print medium 108 may be further processed. For example, in case coating layer is an undercoat, an image pattern may be printed thereon either using a print assembly integrated in the same apparatus as coater 700 or in a printing system at a different location. In other examples, coated print medium 108 may be stored or shipped as a manufactured product so that a third-party may perform printing thereon. Alternatively, coated print medium 108, might be a finished product.

In the following, some specific details of electro-coatings are set forth. An electro-coating is comprised of a carrier liquid (e.g., a hydrocarbon oil) and an electrophoretic element comprised of a coating component. An electro-coating may also include a surfactant/charge director to facilitate charging of the electrophoretic element. Depending on the specific application of the coating, the composition may include additional components. An electro-coating may be based on the same functional principles as a liquid electrophoretic (LEP) ink (e.g., Electro Ink, available from Hewlett-Packard). However, an electro-coating is characterized by being selected for providing an overcoat or an undercoat of a printed image that improves at least one characteristic of the printed image on the substrate (e.g., print quality, ink adhesion, rub resistance, or durability of the printed image pattern on the print medium). Further, some specific components used with LEP inks may be absent from an electro-coating (e.g., heavy oils). An electro-coating may be characterized by the absence of colorant. In some examples, an electro-coating results in a transparent coating layer. In other examples, an electro-coating results in a non-transparent coating layer.

According to some examples, an electro-coating comprises a carrier comprised of a hydrocarbon oil. In some more specific examples, a carrier is comprised of an alkane. Oil carriers suitable for the embodiments disclosed herein include aliphatic hydrocarbon oils. Specific examples include ISOPAR oils G through L (Exxon Mobil Corp., Fairfax Va.) as aliphatic hydrocarbon oils. Other aliphatic oils may also be suitable, such as odorless mineral spirits, or any nonconductive isoparaffin oil. In contrast to other coatings, (e.g., UV coating, which is toxic and produces bad odors) a hydrocarbon based electro-coating is not toxic both for odor and the image itself. Moreover, a hydrocarbon based electro-coating facilitates an energy-efficient coating process.

An LEP element of an electro-coating is characterized by being chargeable and movable within the carrier liquid such that an electro-coating can originate a coating layer using electrostatic forces as described above. Suitable LEP elements may be comprised of a polymer blend. An electro-coating may be comprised of more than one polymer blend. The polymer blend is chosen to provide a coating on the print medium after a coating process as described above is performed. Further components for interacting with ink on the print medium might be embedded into the LEP element. For example, a treatment composition for improving ink adhesion on the substrate might be included on the LEP element. An electro-coating may be constituted such that it is electrically compressible by the developing unit (e.g., a BID as illustrated with respect to FIG. 9 or a electrophoretic electrode as illustrated with respect to FIG. 10) to increase to, at least, 30% the concentration of LEP elements in the electro-coating.

An electro-coating may also include a charge director that imparts a charging of the LEP elements. It will be understood that there are a variety of charge directors that can be used with electro-coatings. Further, it will be understood that the charge director may impart a negative or positive charge to the LEP elements depending upon the specific configuration of the coater and, more specifically, depending upon how the chargeable surface in the photo imaging assembly is being charged. An electro-coating may also include one or more surfactant components, which might be used to improve the separation of LEP particles in the electro-coating. It will be understood that there are a variety of surfactant components that can be used with electro-coatings. Examples of polymer blends, charge directors, and surfactant components are described in, for example, U.S. Pat. No. 7,078,141, which is incorporated herein by reference in its entirety (to the extent in which this document is not inconsistent with the present disclosure) and in particular those parts thereof describing polymer blends, surfactants and charge directors.

The techniques for coating a print medium illustrated herein facilitate providing a coating with a relatively high quality. Further, the spatial location of the coating may be made addressable using a stand-alone coater, which can be built relatively simple as compared to a printing apparatus for printing image patterns on the print medium. For example, a stand-alone coating as described herein does not require a complex data streaming as necessary for printing an image. Further, as compared with other liquid electrophoretic engines, a stand-along coater might be built with a single developer unit.

Coating techniques described herein facilitate a fast and energy efficient drying of the coating. For example, drying of a 0.2 m long print medium may consume approximately 3 kW per 12 inch format width. As a comparison, aqueous coating may require a massive drying unit to dry several microns of water; for example, to achieve 1 μm of solid approximate a 10 μm coating at 10% may be needed; aqueous coating drying of a 0.2 m long print medium may consume approximately 25 kW per 12 inch format width. Moreover, water based coatings may introduce integration challenges when used in-line with a printing assembly due to insufficient drying.

Techniques using electro-coatings as described above also facilitate formation of a relatively thin layer. For example, a coating layer based on electro-coating may have a thickness of less than 2 μm or, more specifically, less than 1.5 μm such as approximately 1 μm. Further, since fusing is not necessarily required for transferring the coating layer and print media may be modestly warmed during coating as described herein, print media that may be damaged by a relatively high temperature can also be coated. An example of such print media are vinyl print media or low temperature acrylic media.

As set forth above, some examples of coating techniques disclosed herein are aimed to addressable coatings, i.e., techniques to provide a coating layer at selected portion of a print media. An addressable coating might also be referred to as digital coating. Digital coating has a wide range of applications In contrast to other digital coating methods (e.g., based on inkjet), coating techniques herein, through the use of electro-coatings, facilitate a wider range of coatings. For example, metallic coatings might be difficult to formulate for inkjet printing.

In an example application, a transparent print medium is to be coated. The transparent print medium might be characterized by relatively low ink absorption so that an undercoat for promoting ink adhesion to the print medium is desirable. Further, it might be desired to leave some parts of the print medium transparent and other opaque. Using techniques described herein, the transparent print medium can be selectively coated using an electro-coating that results in an opaque undercoat. Subsequently, an image pattern might be printed on the undercoated areas of the print medium. Other example application where addressability might be particularly convenient is in the coating of certain adhesive print media, where it is desired to leave some medium areas uncoated for adhesive.

In the foregoing description, numerous details are set forth to provide an understanding of the examples disclosed herein. However, it will be understood that the examples may be practiced without these details. While a limited number of examples have been disclosed, numerous modifications and variations therefrom are contemplated. It is intended that the appended claims cover such modifications and variations. Further, flow charts herein illustrate specific block orders; however, it will be understood that the order of execution may differ from that which is depicted. For example, the order of execution of two or more blocks may be scrambled relative to the order shown. Also, two or more blocks shown in succession may be executed concurrently or with partial concurrence. Further, claims reciting "a" or "an" with respect to a particular element contemplate incorporation of one or more such elements, neither requiring nor excluding two or more such elements. Further, the terms "include" and "comprise" are used as open-ended transitions.

What is claimed is:

1. A coater for coating a print medium, the coater comprising:

a coating supply assembly to supply a liquid electrophoretic coating composition, wherein the liquid electrophoretic coating composition excludes inks; and a photo imaging assembly to receive liquid electrophoretic coating composition from the coating supply assembly on a chargeable surface so as to form a coating layer thereon using electrostatic forces acting on the liquid electrophoretic coating composition, the coating layer to be transferred to the print medium, wherein the coater is a standalone unit.

2. The coater according to claim 1, further comprising includes an addressable charger to selectively charge areas on the chargeable surface of the photo imaging assembly so that the coating layer can be formed on the photo imaging assembly according to a selected pattern.

3. The coater according to claim 1, wherein the photo imaging assembly includes a chargeable dielectric surface.

4. The coater according to claim 1, wherein the coating supply assembly includes a developer roller to receive a layer of liquid electrophoretic coating composition to be supplied to the photo imaging assembly by the electrostatic forces due to a voltage difference between the developer roller and the chargeable surface of the photo imaging assembly.

5. The coater according to claim 1, wherein the coater is configured to directly transfer the coating layer from the photo imaging assembly to the print medium.

6. The coater according to claim 1, further comprising an intermediate transfer member to transfer the coating layer from the photo imaging assembly to the print medium.

7. The coater according to claim 1, further comprising a heating unit to promote transfer of the coating layer to the print medium.

8. The coater according to claim 7, further comprising an intermediate transfer member to transfer the coating layer from the photo imaging assembly to the print medium, wherein the heating unit is to heat the intermediate transfer member to promote transfer of the coating layer on the print medium.

9. The coater according to claim 7, wherein the coater is configured to directly transfer the coating layer from the photo imaging assembly on the print medium and the heating unit is to heat the photo imaging assembly so that the temperature difference between the photo imaging assembly and the print medium promotes transfer of the coating layer on the print medium.

10. The coater according to claim 1, further including a cleaning station to clean a portion of the photo imaging assembly in an area downstream from the area in which the coating layer is transferred from the photo imaging assembly.

11. The coater according to claim 1, wherein the coater is a system dedicated to coating.

12. The coater according to claim 1, wherein the coater is a standalone unit in an image printing system to print an image pattern on the print medium.

13. A printing system for printing an image pattern on a print medium, the system comprising:

a standalone coating unit for coating the print medium with a coating layer, the coating unit including:

a photo imaging assembly to receive a liquid electrophoretic coating composition on a chargeable surface wherein the liquid electrophoretic coating composition excludes inks, and an addressable charger to selectively charge areas on the chargeable surface in a manner such that a layer of the liquid electrophoretic coating can be formed on the chargeable surface according to a selected pattern;

a coating transfer area in which the patterned coating layer is to be to transferred over the print medium; and a printing assembly to selectively deposit colorant on the print medium so as to form a image pattern on the print medium.

14. The system according to claim 13, wherein the printing assembly is to selectively deposit colorant by liquid electrophoretic printing.

15. The system according to claim 13, wherein the printing assembly is to selectively deposit colorant by inkjet printing.

16. The system according to claim 15, wherein the printing assembly includes a full-width inkjet nozzle array for the selective colorant deposition.

17. The coater according to claim 1, wherein the coater provides a resolution of at least two millimeters.

18. The system according to claim 11, wherein the coating unit provides a resolution of at least two millimeters.

* * * * *

UNITED STATES PATENT AND TRADEMARK OFFICE

CERTIFICATE OF CORRECTION

PATENT NO. : 8,968,974 B2
APPLICATION NO. : 13/626391
DATED : March 3, 2015
INVENTOR(S) : Omer Gila et al.

It is certified that error appears in the above-identified patent and that said Letters Patent is hereby corrected as shown below:

In the Drawings:

In sheet 3 of 6, reference numeral 400, line 2, delete “SZSTEM” and insert -- SYSTEM --, therefor.

In sheet 6 of 6, reference numeral 1106, line 1, delete “AN” and insert -- AND --, therefor.

Signed and Sealed this
Eighteenth Day of August, 2015

Michelle K. Lee

Michelle K. Lee
*Director of the United States Patent and Trademark Office*